US008075758B2

(12) United States Patent
Joshi et al.

(10) Patent No.: US 8,075,758 B2
(45) **Date of Patent: *Dec. 13, 2011**

(54) ELECTROLYTIC METHOD TO MAKE ALKALI ALCOHOLATES USING ION CONDUCTING ALKALI ELECTROLYTE/SEPARATOR

(75) Inventors: Ashok V. Joshi, Salt Lake City, UT (US); Shekar Balagopal, Sandy, UT (US); Justin Pendelton, Salt Lake City, UT (US)

(73) Assignee: Ceramatec, Inc., Salt Lake City, UT (US)

( * ) Notice: Subject to any disclaimer, the term of this patent is extended or adjusted under 35 U.S.C. 154(b) by 1320 days.

This patent is subject to a terminal disclaimer.

(21) Appl. No.: 11/611,054

(22) Filed: Dec. 14, 2006

(65) Prior Publication Data

US 2008/0142373 A1 Jun. 19, 2008

Related U.S. Application Data

(60) Continuation-in-part of application No. 11/396,057, filed on Mar. 31, 2006, now Pat. No. 7,959,784, which is a division of application No. 11/010,822, filed on Dec. 13, 2004, and a continuation-in-part of application No. 11/449,953, filed on Jun. 9, 2006.

(60) Provisional application No. 60/528,612, filed on Dec. 11, 2003.

(51) Int. Cl.
*C25B 3/00* (2006.01)

(52) U.S. Cl. ..... 205/450; 205/451; 205/452; 205/453; 205/454; 205/457

(58) Field of Classification Search ..... 205/450–454, 205/457

See application file for complete search history.

(56) References Cited

U.S. PATENT DOCUMENTS

| | | | |
|---|---|---|---|
| 3,197,392 | A | 7/1965 | Silversmith et al. |
| 3,730,857 | A | 5/1973 | Tripp |
| 3,964,983 | A | 6/1976 | Eisenbach et al. |
| 4,217,184 | A | 8/1980 | Kuck et al. |
| 4,250,000 | A | 2/1981 | Kuck et al. |

(Continued)

FOREIGN PATENT DOCUMENTS

| | | |
|---|---|---|
| DE | 139528 | 1/1980 |

(Continued)

OTHER PUBLICATIONS

Young, "International Search Report for PCT/US07/00968 sent Oct. 1, 2007",1-2.

(Continued)

*Primary Examiner* — Keith Hendricks
*Assistant Examiner* — Susan Thai
(74) *Attorney, Agent, or Firm* — David Fonda

(57) ABSTRACT

Alkali alcoholates, also called alkali alkoxides, are produced from alkali metal salt solutions and alcohol using a three-compartment electrolytic cell. The electrolytic cell includes an anolyte compartment configured with an anode, a buffer compartment, and a catholyte compartment configured with a cathode. An alkali ion conducting solid electrolyte configured to selectively transport alkali ions is positioned between the anolyte compartment and the buffer compartment. An alkali ion permeable separator is positioned between the buffer compartment and the catholyte compartment. The catholyte solution may include an alkali alcoholate and alcohol. The anolyte solution may include at least one alkali salt. The buffer compartment solution may include a soluble alkali salt and an alkali alcoholate in alcohol.

36 Claims, 2 Drawing Sheets

U.S. PATENT DOCUMENTS

| | | | | |
|---|---|---|---|---|
| 4,857,665 | A | 8/1989 | Hinrichs et al. | |
| 4,990,413 | A | 2/1991 | Lee et al. | |
| 5,246,551 | A | 9/1993 | Pletcher et al. | |
| 5,258,106 | A | 11/1993 | Habermann et al. | |
| 5,286,354 | A | 2/1994 | Bard et al. | |
| 5,290,404 | A | 3/1994 | Toomey | |
| 5,290,405 | A | 3/1994 | Joshi et al. | |
| 5,389,211 | A | 2/1995 | Sharifian et al. | |
| 5,425,856 | A * | 6/1995 | Buckholtz et al. | 205/451 |
| 5,437,774 | A * | 8/1995 | Laustsen | 204/518 |
| 5,575,901 | A | 11/1996 | Hulme et al. | |
| 5,578,189 | A | 11/1996 | Joshi | |
| 5,580,430 | A | 12/1996 | Balagopal et al. | |
| 5,968,326 | A | 10/1999 | Yelon et al. | |
| 5,985,388 | A | 11/1999 | Tomita et al. | |
| 6,004,445 | A | 12/1999 | Genders et al. | |
| 6,190,407 | B1 | 2/2001 | Ogle et al. | |
| 6,221,225 | B1 | 4/2001 | Mani | |
| 6,333,093 | B1 | 12/2001 | Burrell et al. | |
| 6,398,938 | B2 | 6/2002 | Merk et al. | |
| 6,573,205 | B1 | 6/2003 | Myers et al. | |
| 6,770,187 | B1 | 8/2004 | Putter et al. | |
| 6,805,787 | B2 | 10/2004 | Bess et al. | |
| 2003/0106805 | A1 * | 6/2003 | Horn | 205/450 |
| 2005/0177008 | A1 * | 8/2005 | Balagopal et al. | 568/851 |
| 2005/0204612 | A1 | 9/2005 | Connemann et al. | |
| 2005/0262760 | A1 | 12/2005 | Lawson et al. | |
| 2006/0169594 | A1 | 8/2006 | Balagopal et al. | |
| 2006/0226022 | A1 | 10/2006 | Balagopal et al. | |
| 2007/0138020 | A1 | 6/2007 | Balagopal et al. | |
| 2007/0158205 | A1 | 7/2007 | Balagopal et al. | |
| 2007/0167642 | A1 | 7/2007 | Oku et al. | |
| 2008/0142373 | A1 | 6/2008 | Joshi et al. | |
| 2008/0173540 | A1 | 7/2008 | Joshi et al. | |
| 2008/0173551 | A1 | 7/2008 | Joshi et al. | |
| 2008/0245671 | A1 | 10/2008 | Balagopal et al. | |
| 2009/0056200 | A1 | 3/2009 | Joshi | |
| 2009/0057162 | A1 | 3/2009 | Balagopal et al. | |
| 2009/0178928 | A1 | 7/2009 | Groos et al. | |

FOREIGN PATENT DOCUMENTS

| | | |
|---|---|---|
| DE | 3346131 | 6/1985 |
| DE | 3702052 | 7/1988 |
| DE | 19603181 | 4/1997 |
| DE | 10360758 | 7/2005 |
| EP | 0146771 | 7/1985 |
| EP | 0559400 | 9/1993 |
| EP | 0826794 | 3/1998 |
| GB | 1155927 | 6/1969 |
| HU | 37469 | 12/1985 |
| JP | 53011199 | 2/1978 |
| JP | 59067379 | 4/1984 |
| JP | 07196561 | 8/1995 |
| RO | 103535 | 6/1993 |
| WO | WO-9627697 | 9/1996 |
| WO | WO-03014272 | 2/2003 |

OTHER PUBLICATIONS

Young, "Written Opinion for PCT/US07/00968 sent Oct. 1, 2007",1-5.

Young, "International Search Report for PCT/US06/48746 sent Oct. 1, 2007",1-2.

Young, "Written Opinion for PCT/US06/48746 sent Oct. 1, 2007",1-4.

Phasge, Arun "Final Office Action for U.S. Appl. No. 11/449,953", (Nov. 17, 2009).

Phasge, Arun "Final Office Action for U.S. Appl. No. 11/396,057", (Jul. 23, 2009).

Phasge, Arun "Non-Final Office Action for U.S. Appl. No. 11/396,057", (Dec. 24, 2009).

Phasge, Arun "Final Office Action for U.S. Appl. No. 11/010,822", (Jul. 10, 2009).

Phasge, Arun "Non-Final Office Action for U.S. Appl. No. 11/010,822", (Dec. 28, 2009).

Gregg, Nicholas "European Search Report", European Application No. 06847897.3, PCT App. No. PCT/US2006048746,(Sep. 16, 2009), 1-4.

Young, International Search Report for PCT/US07/25541 sent Mar. 17, 2008, 1-2.

Young, Written Opinion for PCT/US07/25541 sent Mar. 17, 2008, 1-6.

Young, Lee W., "International Search Report", (Jul. 7, 2008),1-2.

Young, Lee W., "Written Opinion of the International Searching Authority", (Jul. 7, 2008),1-5.

Young, Lee W., "International Search Report", (Dec. 18, 2008),1-2.

Young, Lee W., "Written Opinion of the International Searching Authority", (Dec. 18, 2008),1-5.

Young, Lee W., "International Search Report", (Apr. 24, 2009),1-3.

Young, Lee W., "Written Opinion of the International Searching Authority", (Apr. 24, 2009),1-5.

Phasge, Arun S., "Office Action for U.S. Appl. No. 11/449,953", (Apr. 7, 2009),1-9.

Phasge, Arun S., "Office Action for U.S. Appl. No. 11/396,057", (Oct. 10, 2008),1-8.

Hinrichs, et al., "Abstract of DE3702052", Patent Answer 14 of 19 in enclosed search by Science IP, (Jul. 14, 1988), 11.

Phasge, Office Action for U.S. Appl. No. 11/010,822 sent Jun. 30, 2008, 1-6.

Alamo, J. "Chemistry and properties of solids with the [NZP] skeleton", *Solid State Ionics*, vol. 63-65, (1993), 547-561.

Balagopal, S. et al., "Selective Sodium Removal From Aqueous Waste Streams with NaSICON Ceramics", *Separation and Purification Technology*, 15 (1999), 231-237.

Bentzen, J. J., et al., "The preparation and characterization of dense, highly conductive $Na_5GdSi_4O_{12}$ nasicon (NGS)", *Materials Research Bulletin*, vol. 15, (1980), 1737-1745.

Boilot, J.P. et al., "Stoichiometry-Structure-Fast Ion Conduction in the NaSICON Solid Solution", *Solid State Ionics*, 28-30 (1988), North-Holland, Amsterdam, 403-410.

Delmas, C. et al., "Crystal chemistry of the $Na_{1+x}Zr_{2-x}L_x(PO_4)_3$ (L = Cr, In, Yb) solid solutions", *Materials Research Bulletin*, vol. 16, (1981), 285-290.

Fujitsu, S. et al., "Conduction paths in sintered ionic conductive material $Na_{1+x}Y_xZr_{2-x}(PO_4)_3$", *Materials Research Bulletin*, vol. 16, (1981), 1299-1309.

Goodenough, J.B. et al., "Fast $Na^+$-Ion Transport in Skeleton Structures", *Mat. Res. Bull.*, vol. 11, 1976. Pergamon Press, Inc. Printed in the United States, 203-220.

Hong, H.Y-P. et al., "Crystal Structures and Crystal Chemistry in the System $Na_{1+x}Zr_2Si_xP_{3-x}O_{12}$", *Mat. Res. Bull.*, vol. 11, 1976. Pergamon Press, Inc. Printed in the United States., 173-186.

Miyajima, Y. et al., "Ionic conductivity of NASICON-type $Na_{1+x}M_xZr_{2-x}P_3O_{12}$(M: Yb, Er, Dy)", *Solid State Ionics*, vol. 84, (1996), 61-64.

Saito, Y. et al., "Ionic Conductivity of NASICON-type conductors $Na_{1.5}M_{0.5}Zr_{1.5}(PO_4)_3$ (M: $Al^{3+}$, $Ga^{3+}$, $Cr^{3+}$, $Sc^{3+}$, $Fe^{3+}$, $In^{3+}$, $Yb^{3+}$, $Y^{3+}$)", *Solid State Ionics*, vol. 58, (1992), 327-331.

Shannon, R.D. et al., "Ionic Conductivity in $Na_5YSi_4O_{12}$ Type Silicates", *Inorganic Chemistry*, vol. 17, No. 4 (1978), 958-964.

Shimazu, K. et al., "Electrical conductivity and $Ti^{4+}$ ion substitution range in NASICON system", *Solid State Ionics*, vol. 79, (1995), 106-110.

Sutija, Davor et al., "Ceramic Cleansers: Environmental Uses of Sodium Super-Ionic Conducting Ceramics", *The Electrochemical Society Interface*, Winter 1996, vol. 5, No. 4, 26-30.

Van Gerpen, J. et al., "Biodiesel Production Technology", *National Renewable Energy Laboratory, NREL/SR-510-36244*, (Jul. 2004), 1-110.

Von Alpen, V. et al., "Compositional dependence of the electrochemical and structural parameters in the NASICON system ($Na_{1+x}Si_xZr_2P_{3-x}O_{12}$)", *Solid State Ionics*, vol. 3/4, (1981), 215-128.

Desbois, V. International Search Report from PCT application PCT/US/2004/041587, (Dec. 21, 2005), 1-4.

Desbois, V. Written Opinion of the International Searching Authority from PCT application PCT/US/2004/041587, (Dec. 21, 2005), 1-9.

De Jonge, Janos et al., Abstract of HU37469, (Dec. 28, 1985), 1.

Hamann, Carl H., et al., Abstract and claims of DE19603181, (Apr. 17, 1997), 1-2.

Hamann, Carl H., et al., Corresponding abstract DE3346131 (EP0146771), (Jun. 27, 1985), 1.
Horn, Michael Abstract of DE10246375, (May 15, 2003), 1.
Kuhn, Amselm T., et al., Abstract of GB1155927, (Jun. 25, 1969), 1-2.
Lehmann, Thomas et al., Abstract of DE10360758, (Jul. 28, 2005), 1-2.
Oku, Toshio et al., Abstract of JP53011199, (Feb. 1, 1978), 1.
Rooney, K. Abstract and International Search Report for WO03014272, (Nov. 2, 2003) 1-6.
Satou, Hiroshi et al., Abstract of JP59067379, (Apr. 17, 1984), 1.
Cho, Tsurahide et al., Abstract of JP07196561, Patent answer 8 of 19 in enclosed search by Science IP,(Aug. 1, 1995), 8.
Radoi, Ion et al., Abstract of RO103535, Patent answer 10 of 19 in enclosed search by Science IP, (Jun. 15, 1993), 10-11.
Machlitt, Rainer et al., Abstract of DD139528, Patent answer 19 of 19 in enclosed search by Science IP, (Jan. 9, 1980), 14.
Strathmann, H. Abstract of "Bipolar membranes: their properties and applications", *Clean and Efficient Processing: Electrochemical Technology for Synthesis, Separations, Recycle, and Environmental Improvement, international Forum, electrolysis in the Chemical Industry*, 12th. Clearwater Beach, Fla.,, Oct. 11, 1998, 221-251. Non-patent answer 3 of 9 in enclosed search by Science IP, (Oct. 11, 1998), 15-16.
Koter, S. Abstract of "Electrosynthesis of methanolates by membrane electrolysis", *Polish Journal of Chemistry*, (1997), 71(2), 232-243. Non-patent answer 5 of 9 in enclosed search by Science IP, (1997),16-17.
Sridhar, S. Abstract of "Electrodialysis in a non-aqueous medium: production of sodium methoxide", *Journal of Membrane Science*, 1996, 113(1), 73-79. Non-patent answer 6 of 9 in enclosed search by Science IP, (1996), 17.
Hamann, et al., "Abstract of "Transport and conversion processes in the direct electrochemical synthesis of alcoholates with Nafion membranes"", *Chemie Ingenieur Technik*, (1992), 64 (7), 648-649. Non-patent answer 7 of 9 in enclosed search by Science IP, (1992), 17.
"European Patent Office", Search Report for EPO Application No. 08857374.6, (Dec. 14, 2010),1-6.
Park, "Interenational Search Report", International App. No. PCT/US2008/082278, (Jan. 30, 2009),1-3.
Park, "Written Opinion of the International Searching Authority", International App. No. PCT/US2008/082278, (Jan. 30, 2009),1-3.
Young, Lee "PCT/US08/10434 International Search Report", (Dec. 5, 2008),1-2.
Young, Lee "PCT/US08/10434 Written Opinion", (Dec. 5, 2008),1-6.
Friday, Steven "Office Action", U.S. Appl. No. 11/863,846, Jun. 21, 2011,1-23.
Friday, Steven "USPTO Office Action", U.S. Appl. No. 11/865,361, Jun. 22, 2011,1-24.
MacFarlane, D R., et al., "Lithium-ion Conducting Ceramic/Polyether Composites", *Electrochimica Acta*. vol. 43, Issues 10-11, (Apr. 30, 1998),1333-1337.

* cited by examiner

ELECTROLYTIC METHOD TO MAKE ALKALI ALCOHOLATES USING ION CONDUCTING ALKALI ELECTROLYTE/SEPARATOR

RELATED APPLICATION INFORMATION

This application in a continuation-in-part of, and claims priority to, U.S. Utility Patent Application Ser. No. 11/396,057 to Shekar Balagopal and Vinod K. Malhotra, entitled "Electrolytic Method to Make Alkali Alcoholates Using Ceramic ion Conducting Solid Membranes," filed Mar. 31, 2006, which was a divisional application of, and claimed priority to, U.S. patent application Ser. No. 11/010,822, to Shekar Balagopal and Vinod K. Malhotra, entitled "Electrolytic Method to Make Alkali Alcoholates using Ceramic Ion Conducting Solid Membranes," filed Dec. 13, 2004, which claimed, priority under 35. U.S.C §119(e) to U.S. Provisional Patent Application No. 60/528,612, filed Dec. 11, 2003. This application's also a continuation-in-part of, and claims priority to, U.S. Ser. No. 11/449,953 filed Jun. 9, 2006, which is a continuation-in-part of, and claims priority to, U.S. patent application Ser. No. 11/010,822, filed Dec. 13; 2004, which claimed priority under 35 U.S.C §119(e) to U.S. Provisional Patent Application No. 60/528,612, filed Dec. 11, 2003 U.S. patent application Ser Nos. 11/396,057 and 11/449,953 are hereby incorporated by reference.

U.S. GOVERNMENT INTEREST

This invention was made with government support under Contract No. DE-FG36-06GO6036 awarded by the U.S. Department of Energy. The government has certain rights in the invention.

BACKGROUND OF THE INVENTION

This invention relates to electrochemical production of alkali alcoholates, also called alkali alkoxides, and more particularly to the electrochemical production of alkali alcoholates from alkali metal salt solutions and alcohol using an electrolytic cell having an alkali ion conducting ceramic solid electrolyte and separator.

Alkali alcoholates are chemical compounds that are used in a wide variety of industrial applications. Electrolytic systems have been proposed for use in producing alkali alcoholates from salt solutions. In these systems, various ion-conducting solid electrolyte and separator material may be positioned between anolyte, buffer and catholyte compartments for transportation of ions through the alkali ion conductor from one compartment to the other. The solid electrolyte is a specific alkali ion conductor made of polymeric materials or ceramic materials or combinations of ceramic and polymeric materials.

Polymeric materials are often used as electrolytes in the electrolysis of salt solutions because of their high conductivity and resistance to acidic and caustic environments. One disadvantage of polymers, however, is their low selectivity for ionic species. They may permit the desired alkali metal ions to pass through the membrane, but they also allow the electroosmotic transport of water, the result of which is an inefficient operation of the electrolytic cell.

One particularly useful alkali alcoholate is sodium methylate, also called sodium methoxide. Sodium methoxide is made industrially in a sodium-based process in which sodium metal is reacted with methanol to produce sodium methoxide. This method uses sodium metal as a raw material. However, sodium metal is expensive and it may react violently with lower alcohols, thus rendering the process difficult to control. Sodium metal also reacts violently with water requiring elaborate and expensive equipments and systems for storage, handling, and delivery of sodium metal.

Other commercial methods may include making sodium methoxide from a sodium amalgam produced from the chlor-alkali electrolysis in a mercury cell, by reacting amalgam with alcohol. The drawback of this process is that it can result in the contamination of the product and the environment with mercury, a well known carcinogen. For this reason, use of sodium methoxide produced by this method is, in many cases, unattractive for agriculture, pharmaceuticals, and bio-diesel applications.

Thus, it would be an improvement in the art to provide less expensive, more efficient electrolytic methods of producing alkali alkoxides from alkali metal salt solutions using an alkali ion conducting ceramic solid electrolyte or ceramic membrane. It would further be an advancement in the art to provide such a method of making alkali alkoxides that is simple, safe, and environmentally benign. Such a method is provided herein.

BRIEF SUMMARY OF THE INVENTION

In accordance with the present invention, there is provided herein an electrolytic method of making alkali alcoholates, also called alkali alkoxides. The method utilizes an electrolytic cell having at least three compartments, an anolyte compartment configured with an anode, a buffer compartment, and a catholyte compartment configured with a cathode. An alkali ion conducting solid electrolyte configured to selectively transport alkali ions is positioned between the anolyte compartment and the buffer compartment. An alkali ion permeable separator is positioned between the buffer compartment and the catholyte compartment.

In the method, a first catholyte solution is introduced into the catholyte compartment such that the first solution is in communication with the separator and the cathode. The first solution may include an alkali alcoholate and alcohol. A second anolyte solution is introduced into the anolyte compartment such that the second solution is in communication with the alkali ion conducting solid electrolyte and the anode. The second solution may include at least one alkali salt, and it may have a pH greater than about 4. A third solution is fed into the buffer compartment such that it is in communication with the alkali ion conducting solid electrolyte and the separator. The third solution may include a soluble alkali salt and an alkali alcoholate in alcohol, and it may have a pH greater than about 4.

An electric potential is applied to the electrolytic cell to cause a specific alkali ion to pass through the alkali ion conducting solid electrolyte from the anolyte compartment into the buffer compartment. The alkali ions remain in solution in the buffer compartment and diffuse through the porous separator to the catholyte compartment where they react with alcohol to form alkali alcoholate. As alkali alcoholate is formed in the catholyte compartment, an amount of alkali alcoholate is removed to maintain the concentration of the alkali alcoholate in the catholyte compartment between about 2% by weight and about 28% by weight of the contents of the catholyte compartment. In other embodiments, the concentration of alkali alcoholate in the catholyte compartment may range from about 3% and 28% by weight, from about 2% and 20% by weight, and about 5% and 13% by weight of the solution. The concentration of alkali alcoholate affects the ionic conductivity of the solution. If the alkali alcoholate concentration is too low or too high, high ionic resistance of the catholyte solution will lead to high operating voltages.

The alkali ion conducting solid electrolyte is configured to selectively transport alkali ions. It may be a specific alkali ion conductor. For example, the alkali ion conducting solid electrolyte may be a solid MSICON (Metal Super Ion CONducting) material, where M is Na, K, or Li. The alkali ion conducting solid electrolyte may comprise a material having the formula $M_{1+x}Zr_2Si_xP_{3-x}O_{12}$ where $0 \leqq x \leqq 3$, where M is Na, K, or Li. Other alkali ion conducting solid electrolytes may comprises a material having the formula $M_5RESi_4O_{12}$ where M is Na, K, or Li, where RE is Y, Nd, Dy, or Sm, or any mixture thereof. The alkali ion conducting solid electrolyte may comprise a non-stoichiometric alkali-deficient material having the formula $(M_5RESi_4O_{12})_{1-\delta}(RE_2O_3.2SiO_2)_\delta$, where M is Na, K, or Li, where RE is Nd, Dy, or mixture thereof and where δ is the measure of deviation from stoichiometry. The alkali ion conducting solid electrolyte may be beta-alumina.

The alkali ion conducting solid electrolyte may be configured in the form of a monolithic flat plate, a monolithic tube, a monolithic honeycomb, or supported structures of the foregoing. The alkali ion conducting solid electrolyte may be configured as a layered alkali ion conducting ceramic-polymer composite membrane comprising alkali ion selective polymers layered on alkali ion conducting ceramic solid electrolyte materials.

The separator must be permeable to alkali ions. It may be a porous ceramic or a polymer separator material. The separator may be a polyethylene, a polypropylene, organic or ceramic oxide material. The separator may be an alkali ion conducting solid electrolyte similar to the solid electrolyte separating the anolyte compartment and the buffer compartment.

The alcohol may include, but is not limited to, methanol, ethanol, n-propanol, isopropanol, n-butanol, tert-butanol, tert-amyl alcohol and combinations thereof. The alkali alcoholate may include, but is not limited to, an alkali metal methoxide, ethoxide, n-propoxide, isopropoxide, n-butoxide, tert-butoxide, tert-amoxide, wherein the alkali metal is sodium, lithium or potassium. The alkali salt may be of the general formula MX, where M is an alkali metal selected from Na, K, Li, and mixtures thereof, and X is an anion including, but not limited to, $F^-$, $Cl^-$, $Br^-$, $I^-$, $OH^-$, $NO_3^-$, $NO_2^-$, $SO_4^{-2}$, $ClO_3^-$, $ClO_4^-$, $H_3C_2O_2^-$, $HCO_3^-$, $CO_3^{-2}$, $HCOO^-$, $PO_4^{-3}$, and $C_6H_5O_7^{-3}$, and mixtures thereof.

The electrolytic method of making alkali alcoholates may be performed in a continuous or batch operation. In a continuous operation, the first solution may be continuously introduced into the catholyte compartment. Similarly, the second and third solutions may be continuously introduced into the anolyte and buffer compartments, respectively. To be continuous, solutions and/or products must be continuously removed from the catholyte, anolyte, and buffer compartments. The electrolytic method may be performed more efficiently by recycling and reintroducing a portion of the solutions removed from the catholyte, anolyte, and buffer compartments back into the respective compartments.

The electrolytic method, including anodic and cathodic reactions and cell operation, may be performed at a temperature of about 25° C. to about 50° C. In other embodiments, the electrolytic method may be performed at a temperature of about 40° C. to about 70° C.

In the electrolytic method, the alkali ion conducting solid electrolyte may operate at a current density of between about 20 mA/cm$^2$ and about 180 mA/cm$^2$. In one embodiment of the electrolytic method, the alkali ion conducting solid electrolyte operates at a current density of about 100 mA/cm$^2$.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment, but may refer to every embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE SEVERAL VIEWS OF THE DRAWINGS

In order that the manner in which the above-recited and other features and advantages of the invention are obtained will be readily understood, a more particular description of the invention briefly described above will be rendered by reference to specific embodiments thereof that are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

Figure 1:
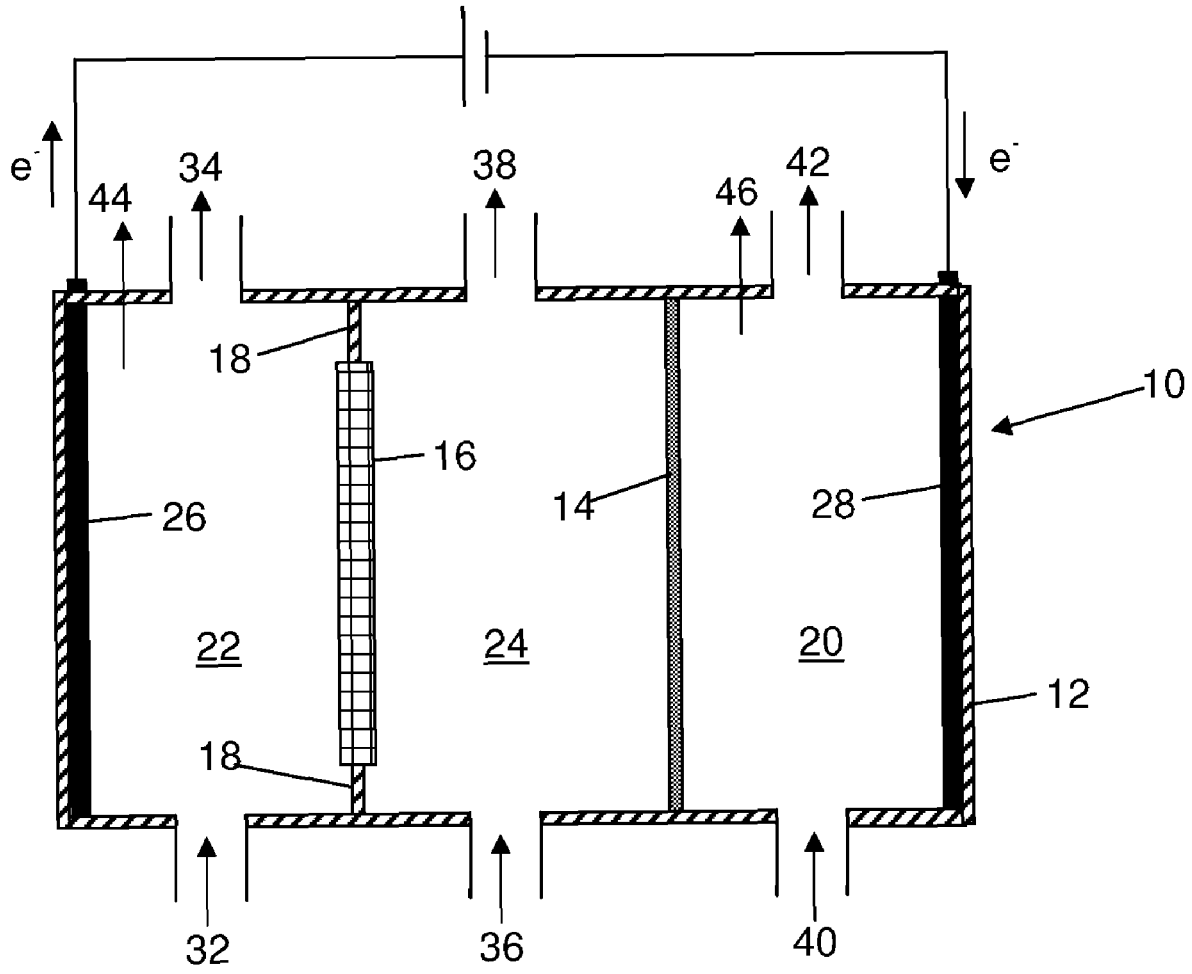
FIG. 1 is a schematic view of a three-compartment electrolytic cell comprising an alkali-cation conductive ceramic membrane within the scope of the present invention.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided, such as examples of cells, membranes, processes, methods, etc., to provide a thorough understanding of embodiments of the invention. One skilled in the relevant art will recognize, however, that the invention may be practiced without one or more of the specific details or method steps, or with other methods, components, materials, and so forth. In other instances, well-known structures, materials, or operations are not shown or described in detail to avoid obscuring aspects of the invention.

The embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments of the three-compartment electrolytic cell using an alkali ion conducting solid electrolyte and separator of the present invention, and processes using the three-compartment electrolytic cell as represented in FIGS. 1 and 2, is not intended to limit the scope of the invention, as claimed, but is merely representative of the embodiments of the invention.

Disclosed herein are processes or methods for the production of non-aqueous alkali alkoxides by electrolysis of an aqueous alkali metal salt solution in an electrolytic cell. Alkali alkoxides are sometime referred to as alkali alcoholates. In one embodiment, the process includes the use of sodium-ion conducting ceramic solid electrolytes. The method may include making solutions of sodium methoxide in methanol in an electrolytic cell from methanol and aqueous sodium hydroxide solution. The process described herein may also be used to make other alkali alkoxides in the corresponding alcohol in an electrolytic cell from alcohol and aqueous alkali metal salt solutions. For example, in one embodiment, the alkyl group is a lower alkyl. The processes and methods of the present invention could also be used to make other alkoxides, including, but not limited to methoxide, ethoxide, n-propoxide (propan-1-ol), isopropoxide(propan-2-ol), n-butoxide(butan-1-ol), tert-butoxide(2-methylpropan-2-ol), and tert-amoxide(2-methylbutan-2-ol). It will be appreciated by those of skill in the art that these alkoxides are commonly offered commercially as dry powders, as solutions in the parent alcohol, or quite often as solutions in other solvents such as cyclohexane, toluene, and tetrahydrofuran. Other alkoxides and forms of alkoxides are known to those of ordinary skill in the art and are included within the scope of the invention. Corresponding alcohols used to make alkoxides may include without limitation, methanol, ethanol, n-propanol, isopropanol, n-butanol, tert-butanol, tert-amyl alcohol and combinations thereof.

Figure 2:
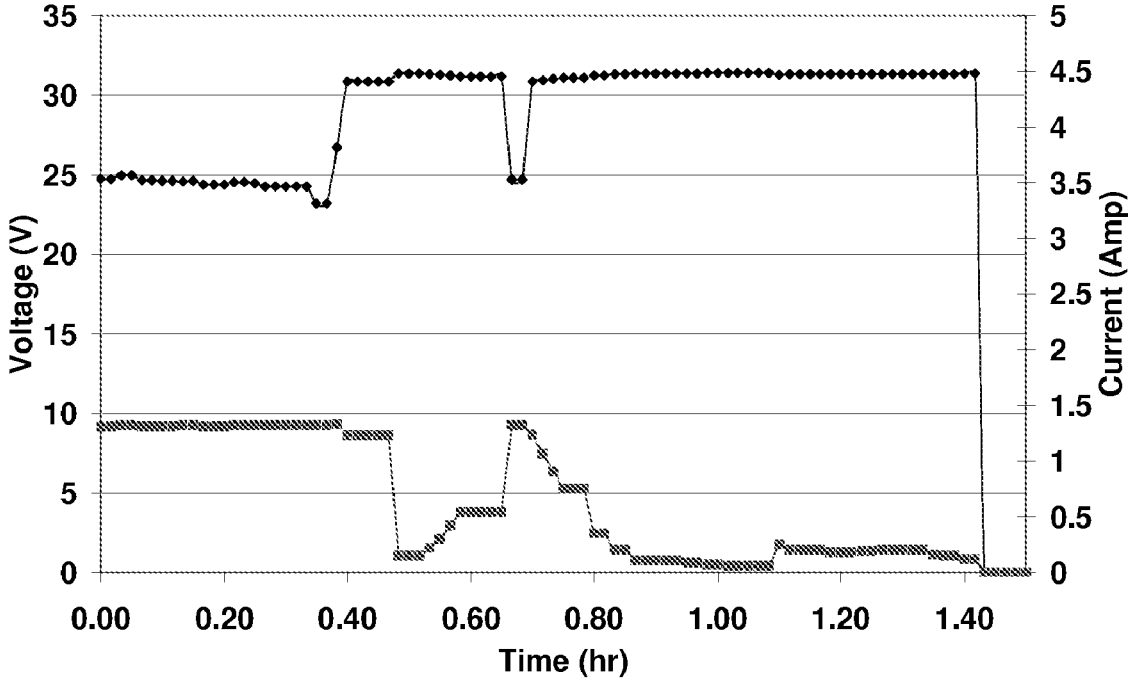
FIG. 2 is a Current-Voltage-Time graph from operating a three compartment electrolytic cell according to FIG. 1 to at 50° C. to make sodium methoxide in methanol solution in the cathode/catholyte compartment.

Referring to FIG. 1, there is provided a schematic representation of an electrolytic cell 10 that can be used in the methods for producing alkali alcoholates according to the present invention described herein. In one embodiment, electrolytic cell 10 is used to make solutions of alkali alcoholates. The electrolytic cell 10 includes a container or shell 12, which may be corrosion resistant. A separator 14 and an alkali ion conducting solid electrolyte 16, which may be positioned in or supported by a scaffold or holder 18, together with the container 12 defines a catholyte compartment 20, an anolyte compartment 22, and a buffer center compartment 24. The anolyte compartment 22 is configured with an anode 26. The catholyte compartment 20 is configured with a cathode 28.

The container 12, and other parts of the electrolytic cell 10, may be made of any suitable material, including metal, glass, plastics, composite, ceramic, other materials, or combinations of the foregoing. The material that forms any portion of the electrolytic cell 10 is preferably not reactive with or substantially degraded by the chemicals and conditions that it is exposed to as part of the electrolytic process.

The electrolytic cell 10 further comprises an anolyte inlet 32 for introducing chemicals into the anolyte compartment 22 and an anolyte outlet 34 for removing or receiving anolyte solution from the anolyte compartment 22. The cell 10 also includes a buffer center compartment inlet 36 for introducing chemicals into the center compartment 24 and a buffer center compartment outlet 38 for removing the solution from the center compartment 24. The cell 10 also includes a catholyte inlet 40 for introducing chemicals into the catholyte compartment 20 and a catholyte outlet 42 for removing or receiving catholyte solution from the catholyte compartment 20. It will be appreciated by those of skill in the art that the cell configuration and relative positions of the inlets and outlets may vary while still practicing the teachings of the invention.

Because gases may be evolved from the cell during operation, venting means (44, 46) are provided to vent, treat and/or collect gases from the anolyte compartment 22 and/or catholyte compartment 20. The means may be a simple venting system such as openings, pores, holes, and the like. The venting means may also include without limitation, a collection tube, hose, or conduit in fluid communication with an airspace or gap above the fluid level in the anolyte and/or catholyte compartments. The gases which are evolved may be collected, vented to outside the electrolytic cell, sent through a scrubber or other treatment apparatus, or treated in any other suitable manner.

The anode 26 and cathode 28 materials may be good electrical conductors stable in the media to which they are exposed. Any suitable material may be used, and the material may be solid, plated, perforated, expanded, or the like. In one embodiment, the anode 26 and cathode 28 material is a dimensionally stable anode (DSA) which is comprised of ruthenium oxide coated titanium ($RuO_2$/Ti). Suitable anodes 26 can also be formed from nickel, cobalt, nickel tungstate, nickel titanate, platinum and other noble anode metals, as solids plated on a substrate, such as platinum-plated titanium. Stainless steel, lead, graphite, tungsten carbide and titanium diboride are also useful anode materials. Suitable cathodes 28 may be formed from metals such as nickel, cobalt, platinum, silver and the like. The cathodes 28 may also be formed from alloys such as titanium carbide with small amounts of nickel. In one embodiment, the cathode is made of titanium carbide with less than about 3% nickel. Other embodiments include cathodes the include $FeAl_3$, $NiAl_3$, stainless steel, perovskite ceramics, and the like. Graphite is also a useful cathode material. In some embodiments, the electrodes are chosen to maximize cost efficiency effectiveness, by balancing electrical efficiency with low cost of electrodes.

The electrode material may be in any suitable form within the scope of the present invention, as would be understood by one of ordinary skill in the art. In some specific embodiments, the form of the electrode materials may include at least one of the following: a dense or porous solid-form, a dense or porous layer plated onto a substrate, a perforated form, an expanded form including a mesh, or any combination thereof.

In some embodiments, only electrolytic reactions occur in the cell and galvanic reactions are eliminated or greatly minimized. Accordingly, the alkali ion conducting solid electrolyte 16 may be a specific alkali ion conductor which may include those which eliminate or minimize galvanic reactions and promote only electrolytic reactions. In one embodiment, the alkali ion conductor has high ionic conductivity with minimal or negligible electronic conductivity. The alkali ion conductor may have high selectivity to preferred ionic species. The alkali ion conductor may also physically separate the anolyte compartment from the center buffer compartment. This may be accomplished using a dense alkali ion conductor. In one embodiment, the solid alkali electrolyte has high ionic conductivity with minimal or negligible electronic conductivity.

In one embodiment, the separator 14 is polymer separator material. The separator 14 may be a porous ceramic or polymer or an organic material that physically separates the catholyte compartment from the center buffer compartment. The separator 14 may be of the type used to separate compartments in batteries. The porosity of the separator may be in the range from 30 to 45% porosity. The separator 14 may be in the form of a alkali-conducting solid electrolyte, similar or identical to solid electrolyte 16.

In some embodiments, for alkali alkoxide production, the electrolytic cell may be operated at temperatures from about 20° C. to about 80° C., including about 25° C., 30° C., 40° C., 50° C., 60° C., and 70° C., and ranges of temperatures bounded by these enumerated temperatures. The temperature is maintained below the boiling point of the solutions used in the catholyte, anolyte, and buffer compartments. The electrolytic cell may also be operated at ambient pressure, with the pressure in the three compartments being substantially equal.

The alkali ion conducting solid electrolyte 16 selectively transports a particular, desired alkali metal cation species from the anolyte compartment 22 to the buffer compartment 24 even in the presence of other cation species. The alkali ion conducting solid electrolyte 16 may also be impermeable to water and/or other undesired metal cations. In some specific embodiments, the alkali ion conducting solid electrolyte 16 has a current density from about 0.3 to about 1 amp/in$^2$ (about 50 to about 150 mA/cm$^2$). In one embodiment, the current through the alkali ion conducting solid electrolyte is predominately ionic current.

In some specific embodiments, the alkali ion conducting solid electrolyte 16 is substantially impermeable to at least the solvent components of both the second or anolyte solution and the third or buffer solution. These alkali ion conducting solid electrolytes 16 may have low or even negligible electronic conductivity, which virtually eliminates any galvanic reactions from occurring when an applied potential or current is removed from the cell containing the solid electrolyte 16. In another embodiment, these alkali ion conducting solid electrolytes 16 are selective to a specific alkali metal ion and hence a high transference number of preferred species, implying very low efficiency loss due to near zero electro-osmotic transport of water molecules.

A variety of alkali ion conducting solid electrolyte materials are known in the art and would be suitable for constructing the alkali ion conducting solid electrolyte 16 of the present invention, as would be understood by one of ordinary skill in the art. In accordance with the present invention, in some specific embodiments alkali ion conducting solid electrolyte 16 compositions comprising an alkali metal ion super ionic conductor (MSICON, where M is Na, K, or Li) materials are utilized for their characteristics of high ion-conductivity for alkali ions at low temperatures, selectivity for alkali ions, current efficiency and chemical stability in water, ionic solvents, and corrosive alkali media under static and electrochemical conditions. Such alkali ion conducting solid electrolytes 16 may have one or more, or all, of the following desirable characteristics which make them suitable for aqueous and non-aqueous electrochemical applications. One characteristic is that, being dense, the solid electrolyte 16 is at least substantially impervious to water transport, and is not influenced by scaling or precipitation of divalent ions, trivalent ions, and tetravalent ions or dissolved solids present in the solutions. The solid electrolyte 16 may selectively transport sodium ions in the presence of other ions at a transfer efficiency that is in some instances above 95%. In yet another embodiment the solid electrolyte 16 provides resistance to fouling by precipitants, and/or electro-osmotic transport of water, which is common with organic or polymer membranes.

As noted above, in some specific embodiments, the alkali cation conducted by the alkali ion conducting solid electrolyte is the sodium ion ($Na^+$). In some specific embodiments, sodium-ion conducting ceramic membranes comprise materials of general formula $Na_{1+x}Zr_2Si_xP_{3-x}O_{12}$ where $0 \leqq x \leqq 3$, as disclosed in U.S. Pat. No. 5,290,405. The alkali ion conducting solid electrolyte may include materials of general formula $Na_5RES_4O_{12}$ and non-stoichiometric sodium-deficient materials of general formula $(Na_5RESi_4O_{12})_{1-\delta}(RE_2O_3.2SiO_2)_\delta$, where RE is Nd, Dy, or Sm, or any mixture thereof and where δ is the measure of deviation from stoichiometry, as disclosed in U.S. Pat. No. 5,580,430. Analogs of these sodium-conducting solid electrolyte materials transport other alkali ions such as Li and K. Such analogs may be used to produce other alkali alkoxides and are known to those of ordinary skill in the art. The foregoing alkali ion conducting solid electrolyte materials are particularly useful in electrolytic systems for simultaneous production of alkali alkoxides by electrolysis of alkali (e.g., sodium, potassium, lithium) salt solutions.

In specific methods, an alkali ion conducting solid electrolyte material 16 separates the anolyte compartment 22 from the center buffer compartment 24. The alkali ions transfer across the solid electrolyte from the anolyte to the center buffer compartment under the influence of electrical potential. Certain alkali ion conducting solid electrolytes do not allow transport of water therethrough, which is useful in making the water-free alkali alkoxides. It is desirable to limit the amount of water that enters the center buffer compartment 24 as a way of preventing water from entering the catholyte compartment 20. Furthermore, these solid electrolyte materials have low electronic conductivity, superior corrosion resistance, and high flux of specific alkali ions providing high ionic conductivity.

In some specific embodiments, the alkali ion conducting solid electrolyte compositions may include at least one of the following: materials of general formula $M_{1+x}M^I{}_2Si_xP_{3-x}O_{12}$ where $0 \leqq x \leqq 3$, where M is selected from the group consisting of Li, Na, K, or mixture thereof, and where $M^I$ is selected from the group consisting of Zr, Ge, Ti, Sn, or Hf, or mixtures thereof; materials of general formula $Na_{1+z}L_zZr_{2-z}P_3O_{12}$ where $0 \leqq z \leqq 2.0$, and where L is selected from the group consisting of Cr, Yb, Er, Dy, Sc, Fe, In, or Y, or mixtures or combinations thereof; materials of general formula $M^{II}{}_5RESi_4O_{12}$, where $M^{II}$ may be Li, Na, or any mixture or combination thereof, and where RE is Y or any rare earth element. In some specific embodiments, the solid electrolyte materials may include at least one of the following: non-stoichiometric materials, zirconium-deficient (or sodium rich) materials of general formula $Na_{1+x}Zr_{2-x/3}Si_xP_{3-x}O_{12-2x/3}$ where $1.55 \leqq x \leqq 3$. In some specific embodiments, the alkali ion conducting solid electrolyte materials may include at least one of the following: non-stoichiometric materials, sodium-deficient materials of general formula $Na_{1+x}(A_yZr_{2-y})(Si_zP_{3-z})O12-\delta$ where A is selected from the group consisting of Yb, Er, Dy, Sc, In, or Y, or mixtures or combinations thereof, $1.8 \leqq x \leqq 2.6$, $0 \leqq y \leqq 0.2$, $x \leqq z$, and δ is selected to maintain charge neutrality. In some specific embodiments, the solid electrolyte materials may include sodium-deficient materials of formula $Na_{3.1}Zr_2Si_{2.3}P_{0.7}O_{12-\delta}$.

Other exemplary sodium super ion conducting materials (NaSICON-type materials) are described by H. Y-P. Hong in "Crystal structures and crystal chemistry in the system $Na_{1+x}Zr_2Si_xP_{3-x}O_{12}$", Materials Research Bulletin, Vol. 11, pp. 173-182, 1976; J. B. Goodenough et al., in "Fast $Na^+$-ion transport skeleton structures", Materials Research Bulletin, Vol. 11, pp. 203-220, 1976; J. J. Bentzen et al., in "The preparation and characterization of dense, highly conductive $Na_5GdSi_4O_{12}$ NaSICON (NGS)", Materials Research Bulletin, Vol. 15, pp. 1737-1745, 1980; C. Delmas et al., in "Crystal chemistry of the $Na_{1+x}Zr_{2-x}L_x(PO_4)_3$ (L=Cr, In, Yb) solid solutions", Materials Research Bulletin, Vol. 16, pp. 285-290, 1981; V. von Alpen et al., in "Compositional dependence of the electrochemical and structural parameters in the NASICON system ($Na_{1+x}Si_xZr_2P_{3-x}O_{12}$)", Solid State Ionics, Vol. 3/4, pp. 215-218, 1981; S. Fujitsu et al., in "Conduction paths in sintered ionic conductive material $Na_{1+x}Y_xZr_{2-x}(PO_4)_3$", Materials Research Bulletin, Vol. 16, pp. 1299-1309, 1981; Y. Saito et al., in "Ionic conductivity of NASICON-type conductors $Na_{1.5}M_{0.5}Zr_{1.5}(PO_4)_3$ (M: $Al^{3+}$, $Ga^{3+}$, $Cr^{3+}$, $Sc^{3+}$, $Fe^{3+}$, $In^{3+}$, $Yb^{3+}$, $Y^{3+}$)", Solid State Ionics, Vol. 58, pp. 327-331, 1992; J. Alamo in "Chemistry and properties of solids with the [NZP] skeleton", Solid State Ionics, Vol. 63-65, pp. 547-561, 1993; K. Shimazu in "Electrical conductivity and $Ti^{4+}$ ion substitution range in NASICON system", Solid State Ionics, Vol. 79, pp. 106-110, 1995; Y. Miyajima in "Ionic conductivity of NASICON-type $Na_{1+x}M_xZr_{2-x}P_3O_{12}$ (M: Yb, Er, Dy)", Solid State Ionics, Vol. 84, pp. 61-64, 1996. These references are incorporated in their entirety herein by this reference.

While the alkali ion conducting solid electrolyte materials disclosed herein encompass or include many formulations of alkali ion super ion conducting (MSICON, where M is an alkali metal) materials, this disclosure includes specific examples of ceramic membranes comprising NaSICON materials for the sake of simplicity. The focused discussion of NaSICON materials as one example of materials is not, however, intended to limit the scope of the invention. For example, the materials disclosed herein as being highly conductive and having high selectivity include those alkali super ion conducting materials that are capable of transporting or conducting any alkali cation, such as sodium (Na), lithium (Li), potassium (K), ions for producing alkali alkoxides.

The alkali ion conducting solid electrolyte materials may be used or produced for use in the processes and apparatus of the present invention in any suitable form, as would be understood by one of ordinary skill in the art. In some specific embodiments, the form of the alkali ion conducting solid electrolyte may include at least one of the following: monolithic flat plate geometries, supported structures in flat plate geometries, monolithic tubular geometries, supported structures in tubular geometries, monolithic honeycomb geometries, or supported structures in honeycomb geometries.

In another embodiment, the solid electrolyte 16 may be a supported membrane known to those of skill in the art. Supported structures or membranes may comprise dense layers of ion-conducting ceramic solid electrolyte supported on porous supports. A variety of forms for the supported membranes are known in the art and would be suitable for providing the supported membranes for alkali ion conducting ceramic membranes with supported structures, including: ceramic layers sintered to below full density with resultant continuous open porosity, slotted-form layers, perforated-form layers, expanded-form layers including a mesh, or combinations thereof. In some embodiments, the porosity of the porous supports is substantially continuous open-porosity so that the liquid solutions on either side of the alkali ion conducting solid electrolyte may be in intimate contact with a large area of the dense-layers of alkali ion conducting ceramic solid electrolytes, and in some, the continuous open-porosity ranges from about 30 volume % to about 90 volume %. In some embodiments of the present invention, the porous supports for the supported structures may be present on one side of the dense layer of alkali ion conducting ceramic solid electrolyte. In some embodiments of the present invention, the porous supports for the supported structures may be present on both sides of the dense layer of alkali ion conducting ceramic solid electrolyte.

A variety of materials for the porous supports or supported membranes are known in the art and would be suitable for providing the porous supports for alkali ion conducting solid electrolyte materials, including: electrode materials, NaSICON-type materials, $\beta^I$-alumina, $\beta^{II}$-alumina, other ion-conducting ceramic solid electrolyte materials, and non-conductive materials such as plastics or ceramic materials, metals, and metal alloys. The thickness of the dense layer of alkali ion conducting solid electrolyte material in monolithic structures is generally from about 0.3 mm to about 5 mm, and in some instances from about 0.5 mm to about 1.5 mm. The thickness of the dense layer of alkali ion conducting ceramic solid electrolyte material in supported-structures is generally from about 25 μm to about 2 mm, and often from about 0.5 mm to about 1.5 mm. Layers as thin as about 25 μm to about 0.5 mm are readily producible, as would be understood by one of ordinary skill in the art.

In some specific embodiments, the porous substrate has similar thermal expansion and good bonding with the alkali ion conducting solid electrolyte as well as good mechanical strength. One of ordinary skill in the art would understand that the number and configuration of the layers used to construct the alkali ion conducting solid electrolyte 16 as supported-structures could be widely varied within the scope of the invention.

In some embodiments, the alkali ion conducting solid electrolytes may be composites of alkali ion conducting ceramic solid electrolyte materials with non-conductive materials, where the non-conductive materials are poor ionic and electronic electrical conductors under the conditions of use. A variety of insulative non-conductive materials are also known in the art, as would be understood by one of ordinary skill in the art. In some specific embodiments, the non-conductive materials may include at least one of the following: ceramic materials, polymers, and/or plastics that are substantially stable in the media to which they are exposed.

Layered alkali ion conducting ceramic-polymer composite membranes are also particularly suitable for use as alkali ion conducting solid electrolytes in the present invention. Layered alkali ion conducting ceramic-polymer composite membranes generally comprise ion-selective polymers layered on alkali ion conducting ceramic solid electrolyte materials. In some specific embodiments, the alkali ion conducting ceramic solid electrolyte materials of the layered alkali ion conducting ceramic-polymer composite membranes may include at least one of the following: alkali ion super ion conducting type materials or beta-alumina. Ion-selective polymer materials have the disadvantage of having poor selectively to sodium ions, yet they demonstrate the advantage of high chemical stability. Therefore, layered alkali ion conducting ceramic-polymer composite membranes of alkali ion conducting ceramic materials with chemically stable ionic-selective polymer layers may be suitable for use in the present invention. In some specific embodiments, the types of ion-selective polymer materials which may be used in the layered alkali ion conducting ceramic-polymer composite structure may include at least one of the following: polyelectrolyte perfluorinated sulfonic polymers, polyelectrolyte carboxylic acid polymers, Nafion® materials (from E.I. du Pont de Nemours, Wilmington, Del.) and polyvinyl chloride (PVC), matrix-based polymers, co-polymers or block-co-polymers.

In some specific embodiments, the polymers for the layered alkali ion conducting ceramic-polymer composite membranes may include at least one of the following features and use characteristics, as would be understood by one of ordinary skill in the art: high chemical stability; high ionic conductivity; good adhesion to alkali ion conducting ceramic materials; and/or insensitivity to impurity contamination.

In some specific embodiments, the alkali ion conducting solid electrolyte may comprise two or more co-joined layers of different alkali ion conducting solid electrolyte materials. Such co-joined alkali ion conducting solid electrolyte layers could include alkali ion super ion conducting materials joined to other alkali ion conducting ceramic materials, such as, but not limited to, beta-alumina. Such co-joined layers could be joined to each other using a method such as, but not limited to, thermal spraying, plasma spraying, co-firing, joining following sintering, etc. Other suitable joining methods are known by one of ordinary skill in the art and are included herein.

The alkali ion conducting ceramic solid electrolyte materials disclosed herein are particularly suitable for use in the electrolysis of alkali metal salt solutions because they have high ion-conductivity for alkali metal cations at low temperatures, high selectivity for alkali metal cations, good current efficiency and stability in water and corrosive media under static and electrochemical conditions. Comparatively, beta alumina is a ceramic material with high ion conductivity at temperatures above 300° C., but has low conductivity at temperatures below 100° C., making it less practical for applications below 100° C.

Sodium ion conductivity in NaSICON structures has an Arrhenius dependency on temperature, generally increases as a function of temperature. The sodium ion conductivity of ceramic membranes comprising NaSICON materials ranges from about $1\times10^{-4}$ S/cm to about $1\times10^{-1}$ S/cm from room temperature to 85° C.

Alkali ion conducting ceramic membranes comprising NaSICON materials, especially of the type described herein, have low or negligible electronic conductivity, and as such aid in virtually eliminating the occurrence of any galvanic reactions when the applied potential or current is removed. Certain NaSICON analogs according to the present invention have very mobile cations, including, but not limited to lithium, sodium, and potassium ions, that provide high ionic conductivity, low electronic conductivity and comparatively high corrosion resistance.

The alkali ion conducting solid electrolyte 16 may have flat plate geometry, tubular geometry, or supported geometry. The solid electrolyte 16 may be sandwiched between two pockets, made of a chemically-resistant HDPE plastic and sealed, by compression loading using a suitable gasket or O-ring, such as an EPDM (ethylene propylene diene monomer) rubber gasket or O-ring.

The phrase "significantly impermeable to water," as used herein, means that a small amount of water may pass through the solid electrolyte 16, but that the amount that passes through is not of a quantity to diminish the usefulness of the sodium methoxide solution product. The phrase "essentially impermeable to water," as used herein, means that no water passes through or that if water passes through the solid electrolyte 16, its passage is so limited so as to be undetectable by conventional means. The words "significantly" and "essentially" are used similarly as intensifiers in other places within this specification.

The separator 14 disposed between the catholyte compartment 20 and the center buffer compartment 24 is permeable to alkali ions. It physically separates the catholyte solution in the compartment from the buffer solution in the buffer compartment. It may be a porous ceramic or a polymer separator material. The separator 14 may be an alkali ion conducting solid electrolyte similar or identical to the solid electrolyte separating the anolyte compartment and the buffer compartment. The separator 14 may be a polymeric alkali cation conductive membrane.

In one embodiment of the present invention it may be advantageous to employ polymeric alkali cation-conductive membranes that are substantially impermeable to at least the solvent components of both the buffer solution in the center buffer compartment and the catholyte solution in the catholyte compartment. The polymeric cation-conductive membrane materials are substantially stable in the media to which they are exposed. A variety of polymeric cation-conductive membrane materials are known in the art and would be suitable for constructing the polymeric cation-conductive membrane of the present invention, as would be understood by one of ordinary skill in the art. In some specific embodiments, the polymeric cation-conductive membranes may include at least one of the following: NEOSEPTA® cation exchange membranes (ASTOM Corporation, Japan, a joint company of Tokuyama Corporation and Asahi Chemical Industry Co., Ltd.) such as grades NEOSEPTA® CM-1, NEOSEPTA® CM-2, NEOSEPTA® CMX, NEOSEPTA® CMS, or NEOSEPTA® CMB; Ionac® MC-3470 cation membrane (Sybron Chemicals Inc, N.J.); ULTREX™ CMI-7000 cation membrane (Socada LLC, NJ); DuPont™ NAFION® films (E.I. du Pont de Nemours, Wilmington, Del.) such as grades NAFION® N112, NAFION® N115, NAFION® N117, NAFION® N1110, NAFION® NE1035, NAFION® NE1135, NAFION® PFSA NRE-211, or NAFION® PFSA NRE-212; and PC-SK cation membrane (PCA GmbH, Germany).

The polymeric cation-conductive membranes may be used or produced for use in the processes and apparatus of the present invention in any suitable form, as would be understood by one of ordinary skill in the art. In some specific embodiments, the form of the polymeric cation-conductive membranes may include at least one of the following: monolithic planar geometries, supported structures in planar geometries, supported structures in tubular geometries, or supported structures in honeycomb geometries. Supported structures may comprise dense layers of polymeric cation-conductive materials supported on porous supports. A variety of forms for the porous supports are known in the art and would be suitable for providing the porous supports for polymeric cation-conductive membranes with supported structures, including: ceramic layers sintered to below full density with resultant continuous open porosity, slotted-form layers, perforated-form layers, expanded-form layers including a mesh, or combinations thereof. In some embodiments, the porosity of the porous supports is substantially continuous open-porosity so that the liquid solutions on either side of the polymeric cation-conductive membrane may be in intimate contact with a large area of the dense-layers of polymeric cation-conductive materials, and in some, the continuous open-porosity ranges from about 30 volume % to about 90 volume %. In some embodiments of the present invention, the porous supports for the supported structures may be present on one side of the dense layer of polymeric cation-conductive material. In some embodiments of the present invention, the porous supports for the supported structures may be present on both sides of the dense layer of polymeric cation-conductive material. One of ordinary skill in the art would understand that the number and configuration of the layers used to construct the polymeric cation-conductive membrane as supported-structures could be widely varied within the scope of the invention.

In embodiments of the electrolytic cell, the catholyte solution comprises one or more alkali alkoxides, also known as alkali alcoholates, in one or more alcohols, the anolyte solution comprises one or more aqueous inorganic and/or organic alkali salts, and the center buffer solution comprises an alkali salt and one or more alkali alkoxides in one or more alcohols. The alkali salt in the center buffer solution is preferably soluble in the one or more alcohols. The alkali salt in the anolyte solution may or may not be the same as the alkali salt in the center buffer solution. The alkali salt may be of the general formula MX, where M is an alkali metal selected from Na, K, Li, and mixtures thereof, and X is an anion including, but not limited to, $F^-$, $Cl^-$, $Br^-$, $I^-$, $OH^-$, $NO_3^-$, $NO_2^-$, $SO_4^{-2}$, $ClO_3^-$, $ClO_4^-$, $H_3C_2O_2^-$, $HCO_3^-$, $CO_3^{-2}$, $HCOO^-$, $PO_4^{-3}$, and $C_6H_5O_7^{-3}$, and mixtures thereof.

In one embodiment, the electrolytic cell 10 may be operated as a continuous operation (in a continuous mode) or as a batch operation (in a batch mode). For example, in continuous operation or mode, a first or catholyte solution is introduced into the catholyte compartment 20 of the electrolytic cell 10. A second or anolyte solution is introduced into the anolyte compartment 22. A third or buffer solution is introduced into the center buffer compartment 24. Thus, the anolyte compartment 22 is initially filled with anolyte solution comprising an alkali metal salt solution, the buffer compartment 24 is initially filled with a buffer solution comprising an alkali metal salt in a solution of alkali alkoxide in alcohol, and the catholyte compartment 20 is initially filled with catholyte solution comprising a solution of alkali alkoxide in alcohol. The catholyte solution preferably has a composition of between about 2% by weight alkali alkoxide and about 28% by weight alkali alkoxides in solution.

An electric potential is applied across the electrolytic cell via anode 26 and cathode 28, and then, during operation, additional solutions are fed or introduced into the cell through the inlets 32, 36, 40 and products, by-products, and/or diluted solutions are removed from the cell through the outlets 34, 38, 42 and/or the venting means 44, 46 without ceasing operation of the cell, whilst maintaining the composition of the solution of alkali alkoxide in alcohol in the catholyte compartment 28 to comprise between about 2% by weight alkali alkoxide and about 28% by weight alkali alkoxide.

In another embodiment of continuous operation for the electrolytic cell 10, the anolyte compartment 22 is initially filled with anolyte solution comprising an alkali metal salt solution. The catholyte compartment 20 is initially filled with catholyte solution comprising a solution of alkali alkoxide in alcohol with a composition of between at least about 3% by weight alkali alkoxide and at most about 28% by weight alkali alkoxides. The center buffer compartment 24 is initially filled with a buffer solution comprising an alkali metal salt in a solution of alkali alkoxide in alcohol. An electric potential is applied across the electrolytic cell via anode 26 and cathode 28, and then, during operation, additional solutions are fed or introduced into the cell through the inlets 32, 36, 40 and products, by-products, and/or diluted solutions are removed from the cell through the outlets 34, 38, 42 and/or the venting means 44, 46 without ceasing operation of the cell, whilst maintaining the composition of the solution of alkali alkoxide in alcohol in the catholyte compartment 20 to comprise between at least about 3% by weight alkali alkoxide and at most about 28% by weight alkali alkoxide.

In another embodiment of continuous operation for the electrolytic cell 10, the anolyte compartment 22 is initially filled with anolyte solution comprising an alkali metal salt solution. The catholyte compartment 20 is initially filled with catholyte solution comprising a solution of alkali alkoxide in alcohol with a composition of between about 5% by weight alkali alkoxide and about 13% by weight alkali alkoxide. The center buffer compartment 24 is initially filled with a buffer solution comprising an alkali metal salt in a solution of alkali alkoxide in alcohol. An electric potential is applied across the electrolytic cell via anode 26 and cathode 28, and then, during operation, additional solutions are fed introduced into the cell through the inlets 32, 36, 40 and products, by-products, and/or diluted solutions are removed from the cell through the outlets 34, 38, 42 and/or the venting means 44, 46 without ceasing operation of the cell, whilst maintaining the composition of the solution of alkali alkoxide in alcohol in the catholyte compartment 20 to comprise between about 5% by weight alkali alkoxide and about 13% by weight alkali alkoxide.

Continuous operation may include introducing or feeding the first or catholyte solution, the second or anolyte solution, or the third or buffer solution continuously or intermittently such that the flow of a given solution is initiated or stopped according to the need for the solution and/or to maintain desired concentrations of solutions in the cell, without emptying one or more compartments. Similarly, continuous operation may include the removal of solutions from the anolyte compartment and the catholyte compartment continuously or intermittently. Control of the addition and/or removal of solutions from the cell may be done by any suitable means. Such means include manual operation, such as by one or more human operators, and automated operation, such as by using sensors, electronic valves, laboratory robots, etc., operating under computer or analog control. In automated operation, a valve or stopcock may be opened or closed according to a signal received from a computer or electronic controller on the basis of a timer, the output of a sensor, or other means. Examples of automated systems are well known in the art. Some combination of manual and automated operation may also be used. Alternatively, the amount of each solution that is to be added or removed per unit time to maintain a steady state may be experimentally determined for a given cell, and the flow of solutions into and out of the system set accordingly to achieve the steady state flow conditions.

In certain embodiments, introducing a first solution into the catholyte compartment includes recycling at least a portion of the solution received from the catholyte compartment back into the catholyte compartment. Additionally, introducing a second solution into the anolyte compartment comprises recycling at least a portion of the solution received from the anolyte compartment back into the anolyte compartment. Likewise, introducing a third solution into the buffer compartment comprises recycling at least a portion of the solution received from the buffer compartment back into the buffer compartment. In this manner, solution concentrations and pH levels in the respective compartments may be controlled or managed. For example in one embodiment, the pH of the solution in the anolyte compartment is above about pH 4. In another embodiment, the pH of the solution in the buffer compartment is above about pH 4. Various pH levels can be maintained and/or controlled in any compartment in the production of alkali alkoxides.

In another embodiment, the electrolytic cell 10 may be operated as a batch operation in a batch mode. In one embodiment of batch operation for the electrolytic cell 10, the anolyte compartment 22 is initially filled with anolyte solution comprising an alkali metal salt solution. The catholyte compartment 20 is initially filled with catholyte solution comprising a solution of alkali alkoxide in alcohol with a composition of between about 2% by weight alkali alkoxide and about 20% by weight alkali alkoxide. The center buffer compartment 24 is initially filled with a buffer solution comprising an alkali metal salt in a solution of alkali alkoxide in alcohol. An electric potential is applied across the electrolytic cell via anode 26 and cathode 28, and the electrolytic cell is operated with by-products removed from the cell through venting means 44, 46, until the desired concentration of alkali alkoxide in alcohol is produced in the catholyte compartment 20, whilst maintaining the composition of the solution of alkali alkoxide in alcohol in the catholyte compartment 20 to comprise between about 2% by weight alkali alkoxide and about 28% by weight alkali alkoxide. The electrolytic cell 10 is then emptied, the alkali alkoxide in alcohol product collected or received, and the electrolytic cell refilled to start the process again. Similar batch mode operation may be performed with varying initial solution concentrations.

It should be noted that both continuous and batch operation may have dynamic flow of solutions. In one embodiment for continuous mode operation, anolyte make up solution is added via anolyte inlet 32 to maintain the alkali ion concentration at a certain concentration in the anolyte compartment 22. In one embodiment of batch mode operation, a certain quantity of alkali ions are removed from anolyte compartment 22 due to alkali ion transfer through the alkali ion conducting solid electrolyte 16 into the buffer compartment 24. The buffer compartment is intended to maintain a substantially constant alkali ion concentration, such that as alkali ions enter the buffer compartment 24 from the anolyte compartment 22, a substantially equal amount of alkali ions transfer through the separator 14 into the catholyte compartment 20. Batch mode operation is stopped when the alkali ion concentration in the anolyte compartment 22 reduces to a certain amount or when the appropriate alkali alkoxide concentration is reached in the catholyte compartment 20, whilst maintaining the composition of the solution of alkali alkoxide in alcohol in the catholyte compartment 20 to comprise between about 2% by weight alkyl alkoxide and about 28% by weight alkyl alkoxide.

The following examples are given to illustrate various embodiments within the scope of the present invention. These are given by way of example only, and it is understood that the following examples are not comprehensive or exhaustive of the many types of embodiments of the present invention that can be prepared in accordance with the present invention.

Example 1

A three compartment electrolytic cell as shown in FIG. 1 was operated at 50° C. in a batch mode. The solid electrolyte membrane 16 was a sodium ion conductive solid ceramic electrolyte and the separator 14 was a porous polymer separator. The anolyte solution in the anolyte compartment 22 included aqueous sodium hydroxide. The catholyte solution in the catholyte compartment 20 included sodium methoxide in methanol. The buffer solution in the buffer compartment 24 included sodium iodide and sodium methoxide in methanol. The anolyte, catholyte and feed to the center buffer compartment were continually circulated (recycled). In the test, the electrolytic cell was operated in a galvanostatic mode. Under the influence of an electric field, a voltage and direct current was applied to the anode and cathode electrodes. The voltage and direct current were measured and reported graphically in FIG. 2. The electrode reactions caused $Na^+$ ions to transport from the aqueous sodium hydroxide anolyte (anolyte compartment) through the ion conducting solid electrolyte into the middle buffer compartment where $Na^+$ ions exchange with the buffer solution (NaI+sodium methoxide in methanol). The electrode reactions are summarized below:

$$\text{Anode: } 2NaOH \rightarrow 2Na^+ + \tfrac{1}{2} O_2 + H_2O + 2e^- \quad (1)$$

$$\text{Cathode: } 2CH_3OH + 2e^- + 2Na^+ 2NaOCH_3 + H_2 \quad (2)$$

$$\text{Overall } 2NaOH + 2CH_3OH \rightarrow 2NaOCH_3 + H_2 + \tfrac{1}{2}O_2 + H_2O \quad (3)$$

The $Na^+$ ions passed through the polymer separator and into the third catholyte compartment where they reacted to from the sodium methoxide in methanol (alkali metal alcoholate).

The buffer compartment within the scope of the present invention helps prevent water from transporting from the anolyte compartment to the catholyte compartment. It is preferred to avoid water contamination of the alkali alcoholate in alcohol produced in the catholyte compartment. The buffer compartment provides a buffer zone which captures water that may enter the buffer compartment from the anolyte compartment. In this manner, the buffer compartment permits the use of low cost aqueous alkali salts in the anolyte compartment.

Another purpose of the buffer compartment is to provide high alkali ion conductivity. The alkali salts used within the buffer compartment are preferably highly soluble in alcohol. A wide selection of suitable alkali salts may be used in the buffer compartment.

The methods of the present invention, including those described above, are clean in that essentially all materials made from the process are useful, recyclable, and/or not environmentally harmful. For example, the dilute caustic solution discharged from the anolyte compartment 22 via anolyte outlet 34 may be concentrated and then used again, including being recycled back into this process. The oxygen and hydrogen gases produced at the anolyte compartment and the catholyte compartment, respectively, may be collected, transported, and/or pressurized for use. The gas may also be run through a condenser or a scrubber to remove impurities. The hydrogen gas produced can be used as a fuel or in an alternative energy source such as fuel cells. In one embodiment, the hydrogen gas produced by the cell is used, directly or indirectly, to power the cell and/or its components. Alternatively, the gaseous output may be vented to the environment, with or without the use of scrubbers, fire suppressors, or other safety precautions.

Methods using sodium hydroxide as a starting solution may also be generally cost effective as compared to other methods where sodium metal is reacted directly with methanol to form sodium methoxide. Sodium hydroxide is easier and safer to handle than sodium metal, which requires special storage, handling, and delivery systems to prevent auto-ignition of sodium metal or its violent exothermic reaction with water in the environment. Sodium hydroxide is generally also less expensive than sodium metal for an equivalent molar quantity of sodium atoms.

The alkyl alkoxide produced in one embodiment has a high purity, with the purity being primarily limited by the purity of alcohol that is used as a starting material. Alkyl alkoxide solutions are also substantially free of mercury and/or other heavy metals. As used herein, "substantially free" of mercury is a broad functional term that includes where there is essentially no mercury detectable within test limits ("essentially free") and where there is a small amount of mercury detected, but not at a quantity to limit the material's use in biodiesel production. In one embodiment, the amount of mercury in the solution is not detectable by methods of detection used in the art. In another embodiment, the sodium alkoxide solution is colorless or substantially colorless.

While specific embodiments of the present invention have been illustrated and described, numerous modifications come to mind without significantly departing from the spirit of the invention, and the scope of protection is only limited by the scope of the accompanying claims.

The invention claimed is:

1. A method for producing alkali alcoholate, comprising:

(a) providing an electrolytic cell comprising:

an alkali ion conducting solid electrolyte configured to selectively transport alkali ions, the solid electrolyte positioned between an anolyte compartment configured with an anode and a buffer compartment, and a porous separator configured to transport alkali ions, the separator positioned between the buffer compartment and a catholyte compartment configured with a cathode;

(b) introducing a first solution comprising alkali alcoholate and alcohol into the catholyte compartment of the electrolytic cell such that said first solution is in communication with the porous separator and the cathode;

(c) introducing a second solution comprising at least one alkali salt into the anolyte compartment of the electrolytic cell such that said second solution is in communication with the alkali ion conducting solid electrolyte and the anode;

(d) feeding a third solution comprising alkali alcoholate, alcohol and alkali salt into the buffer compartment;

(e) applying an electric potential to the electrolytic cell to cause alkali ions to pass through the alkali ion conducting solid electrolyte into the second buffer compartment and to cause alkali ions from the buffer compartment to diffuse through the porous separator into the catholyte compartment and to form alkali alcoholate in the catholyte compartment, wherein the alkali ion concentration in the buffer compartment remains substantially constant;

(f) maintaining the concentration of the alkali alcoholate in the catholyte compartment of the electrolytic cell between about 2% by weight and about 28% by weight of the contents of the catholyte compartment; and (g) removing alkali alcoholate from the catholyte compartment.

2. The method according to claim 1 wherein the separator is porous ceramic or a polymer separator material.

3. The method according to claim 1 wherein the separator is alkali ion conducting solid electrolyte.

4. The method according to claim 1 wherein the alkali ion conducting solid electrolyte is a specific alkali ion conductor.

5. The method according to claim 1, wherein the alcohol comprises one of the group consisting of methanol, ethanol, n-propanol, isopropanol, n-butanol, tert-butanol, tert-amyl alcohol and combinations thereof.

6. The method according to claim 1, wherein the alkali alcoholate comprises one of the group consisting of alkali methoxide, alkali ethoxide, alkali n-propoxide, alkali isopropoxide, alkali n-butoxide, alkali tert-butoxide, alkali tert-amoxide of sodium, lithium and potassium.

7. The method according to claim 1, wherein the first solution and the third solution contain an alkali alcoholate selected from the group consisting of alkali methoxide, alkali ethoxide, alkali n-propoxide, alkali isopropoxide, alkali n-butoxide, alkali tert-butoxide, alkali tert-amoxide of sodium, lithium and potassium.

8. The method according to claim 1, wherein the first solution and the third solution contain an alkali alcoholate comprising an alkali metal selected from Na, K and Li and mixtures thereof, in alcohol.

9. The method according to claim 1, wherein the third solution contains an alkali salt of MX, where M is an alkali metal selected from Na, K, Li, and mixtures thereof, and X is an anion including, but not limited to, $F^-$, $Cl^-$, $Br^-$, $I^-$, $OH^-$, $NO_3^-$, $NO_2^-$, $SO_4^{-2}$, $ClO_3^-$, $ClO_4^-$, $H_3C_2O_2^-$, $HCO_3^-$, $CO_3^{-2}$, $HCOO^-$, $PO_4^{-3}$, and $C_6H_5O_7^{-3}$, and mixtures thereof.

10. The method according to claim 1, wherein the second solution contains an alkali salt of MX, where M is an alkali metal selected from Na, K, Li, and mixtures thereof, and X is an anion including, but not limited to, F, $Cl^-$, $Br^-$, $I^-$, $OH^-$, $NO_3^-$, $NO_2^-$, $SO_4^{-2}$, $ClO_3^-$, $ClO_4^-$, $H_3C_2O_2^-$, $HCO_3^-$, $CO_3^{-2}$, $HCOO^-$, $PO_4^{-3}$, and $C_6H_5O_7^{-3}$, and mixtures thereof.

11. The method according to claim 1, wherein introducing a second solution into the catholyte compartment comprises a continuous operation.

12. The method according to claim 1, wherein introducing a first solution into the anolyte compartment comprises a continuous operation.

13. The method according to claim 1, wherein introducing a third solution into the buffer compartment comprises a continuous operation.

14. The method according to claim 1, wherein introducing a first solution into the catholyte compartment comprises recycling at least a portion of the solution received from the catholyte compartment back into the catholyte compartment.

15. The method according to claim 1, wherein introducing a second solution into the anolyte compartment comprises recycling at least a portion of the solution received from the anolyte compartment back into the anolyte compartment.

16. The method according to claim 1, wherein introducing a third solution into the buffer compartment comprises recycling at least a portion of the solution received from the buffer compartment back into the buffer compartment.

17. The method according to claim 1, wherein the concentration of the alkali alcoholate in the catholyte compartment of the electrolytic cell is maintained between about 2% by weight and about 20% by weight of the contents of the catholyte compartment.

18. The method according to claim 1, wherein the concentration of the alkali alcoholate in the catholyte compartment of the electrolytic cell is maintained between about 5% by weight and about 13% by weight of the contents of the catholyte compartment.

19. The method according to claim 1 wherein the electrolytic cell is operated at a temperature of about 25° C. to about 50° C.

20. The method according to claim 1 wherein the electrolytic cell is operated at a temperature of about 40° C. to about 70° C.

21. The method according to claim 1 wherein the separator between the buffer compartment and the catholyte compartment is a porous polyethylene separator.

22. The method according to claim 1 wherein the separator between the buffer compartment and the catholyte compartment is a porous polypropylene, organic or ceramic oxide, material.

23. The method according to claim 1 wherein the separator between the buffer compartment and the catholyte compartment comprising an alkali ion conducting solid electrolyte.

24. The method according to claim 1 wherein the alkali ion conducting solid electrolyte separating the buffer compartment from the anolyte compartment is an organic or a polymer ion exchange membrane.

25. The method according to claim 1 wherein the alkali ion conducting solid electrolyte separating the buffer compartment from the anolyte compartment is a solid alkali metal ion super ion conducting material, wherein the alkali metal is Na, K, or Li.

26. The method according to claim 1, wherein the alkali ion conducting solid electrolyte separating the buffer compartment from the anolyte compartment comprises a material having the formula $M_{1+x}Zr_2Si_xP_{3-x}O_{12}$ where $0 \leqq x \leqq 3$, where M is Na, K, or Li.

27. The method according to claim 3, wherein the alkali ion conducting solid electrolyte comprises a material having the formula $Na_{1+x}Zr_2Si_xP_{3-x}O_{12}$ where $0 \leqq x \leqq 3$.

28. The method according to claim 3, wherein the alkali ion conducting solid electrolyte comprises a material having the formula $M_5RESi_4O_{12}$ where M is Na, K, or Li, where RE is Y, Nd, Dy, or Sm, or any mixture thereof.

29. The method according to claim 3, wherein the alkali ion conducting solid electrolyte comprises a non-stoichiometric alkali-deficient material having the formula $(M_5RESi_4O_{12})_{1-\delta}(RE_2O_3.2SiO_2)_\delta$, where M is Na, K, or Li, where RE is Nd, Dy, or Sm, or any mixture thereof and where δ is the measure of deviation from stoichiometry.

30. The method according to claim 3 wherein the said alkali ion conducting solid electrolyte is beta-alumina.

31. The method according to claim 1, wherein the anolyte solution comprises a pH of greater than about 4.

32. The method according to claim 1, wherein the buffer compartment solution comprises a pH of greater than about 4.

33. The method according to claim 1, wherein the alkali ion conducting solid electrolyte operates at a current density of between about 20 $mA/cm^2$ and about 180 $mA/cm^2$.

34. The method according to claim 1, wherein the alkali ion conducting solid electrolyte operates at a current density of about 100 $mA/cm^2$.

35. The method according to claim 3 wherein the alkali ion conducting solid electrolyte comprises a monolithic flat plate, a monolithic tube, a monolithic honeycomb, or supported structures of the foregoing.

36. The method according to claim 3, wherein the alkali ion conducting solid electrolyte comprises a layered alkali ion conducting ceramic-polymer composite membrane, comprising sodium ion-selective polymers layered on alkali ion conducting ceramic solid electrolyte materials.

* * * * *